US005156900A

United States Patent [19]

Nishimura

[11] Patent Number: 5,156,900

[45] Date of Patent: Oct. 20, 1992

[54] LEATHER-LIKE SHEET MATERIALS AND METHOD OF PRODUCING SAME

[75] Inventor: Takeo Nishimura, Okayama, Japan

[73] Assignee: Kuraray Co., Ltd., Kurashiki, Japan

[21] Appl. No.: 653,989

[22] Filed: Feb. 11, 1991

Related U.S. Application Data

[63] Continuation of Ser. No. 249,322, Sep. 26, 1988, abandoned.

[30] Foreign Application Priority Data

Sep. 28, 1987 [JP] Japan ..... 244817
Sep. 28, 1987 [JP] Japan ..... 244818

[51] Int. Cl.[5] ..... B32B 3/26; B32B 27/40

[52] U.S. Cl. ..... 428/151; 428/315.5; 428/315.9; 428/423.3; 428/904; 427/245

[58] Field of Search ..... 428/904, 423.3, 151, 428/315.5, 315.7, 315.9

[56] References Cited

U.S. PATENT DOCUMENTS 3,284,274 11/1966 Hulslander et al. .
3,968,292 7/1976 Pearman ..... 428/213
3,968,293 7/1976 Cunningham et al. ..... 428/213
3,974,320 8/1976 Gerlach ..... 428/283
4,018,954 4/1977 Fukushima et al. .
4,028,161 6/1977 Fukushima et al. .
4,071,390 1/1978 Strassel ..... 428/315
4,190,694 2/1980 Mück et al. ..... 428/315.9 X
4,515,852 5/1985 Katabe et al. ..... 428/246
4,714,652 12/1987 Poletto ..... 428/308.4

FOREIGN PATENT DOCUMENTS 1034556 12/1974 Japan .
1034656 12/1974 Japan .
4711155 2/1978 Japan .
42109 11/1978 Japan .
4752261 11/1979 Japan .

*Primary Examiner*—George F. Lesmes
*Assistant Examiner*—Terrel Morris
*Attorney, Agent, or Firm*—Kramer, Brufsky & Cifelli

[57] ABSTRACT

A leather-like sheet material resembling natural leather is provided which has a microporous surface and comprises a fibrous substrate layer (1) and a porous, skinless surface layer (2) having an apparent density of 0.25–0.48 g/cm$^3$ with pores having an average diameter of 15–300 μm being predominantly present therein. The surface layer (2) comprises polyurethane I in which the organic diisocyanate constituent is an aromatic ring-containing organic diisocyanate and the porous structure of at least the surface portion of the surface layer (2) is provided with polyurethane II prepared from an organic diisocyanate, which mainly comprises an aliphatic diisocyanate and/or an alicyclic diisocyanate, a polymer diol and a chain extender. The surface portion of the surface layer of the leather-like sheet material may be provided with a polyurethane coat layer which mainly comprises a fine particle polyurethane, or a coat layer made of a composition composed of a polyurethane, which mainly comprises a fine particle polyurethane and a polyoxyethylene- or glycerol-modified hardened oil.

3 Claims, 3 Drawing Sheets

LEATHER-LIKE SHEET MATERIALS AND METHOD OF PRODUCING SAME

This application is a continuation of application Ser. No. 07/249,322, filed Sept. 26, 1988, now abandoned.

FIELD OF THE INVENTION

This invention relates to a leather-like sheet material which has low resiliency, is soft and flexible, has a surface giving a moist feeling when touched with the hand and has good moisture permeability. The invention further relates to a leather-like sheet material which exhibits excellent surface strength, break strength of the porous structure thereof, and the like.

BACKGROUND OF THE INVENTION

A number of proposals have previously been made for improving the surface physical characteristics of leather-like sheet materials having a porous surface layer made of a polymer mainly comprising polyurethane. A principal objective has been to reproduce as nearly as possible the texture, performance and visual characteristics of natural leather. In particular, attempts have been made to improve the shape and appearance of surface wrinkles and creases, air permeability, moisture permeability, resiliency, and so on by modifying raw materials, manufacturing conditions and or other factors to thereby modify the structure and constitution of the leather-like sheet material in question.

For example, Japanese Patent Publication Nos. 20273/65, 38623/72 and 963/79 disclose removing the skin layer of a sheet material by abrading the porous surface having a honeycomb-like porous structure (average diameter about 20–200 μm) and forming a polymer coat layer on the thus-exposed surface in order to improve the characteristics of the material. Most of the pores thus formed are not less than 10 μm in size, thereby converting the surface to the so-called grain side. Japanese Patent Publication Nos. 10345/81 and 10346/81 disclose leather-like sheet materials having microholes on the surface, which are produced by coating a porous surface layer having a large number of microholes, 3–100 μm in size, with a polyurethane solution to thereby adjust the size of the microholes. Japanese Patent Publication No. 47522/86 discloses a method of finishing leather-like sheet materials which comprises applying a dispersion of fine particles of a polymer, for example polyurethane, to a surface having microholes. Japanese Patent Publication No. 44111/80 proposes to use a composition in which a methacrylic ester polymer is dispersed in a polyurethane solution as a finish coating composition. Japanese Patent Publication No. 42109/84 proposes to apply a polycyclic carboxylic acid containing at least 11 carbon atoms or an ester thereof to obtain an improvement in the feeling and texture of the surface.

While these efforts have achieved some improvements in appearance and performance characteristics of leather-like sheet materials, for example by rendering them similar in shape of wrinkles and creases to natural leathers, improving the drapability, or increasing the air permeability and moisture permeability, the prior art leather-like sheet materials are still dry and feel rough to the touch. It has therefore been necessary to treat the prior art leather-like sheet materials with a softening agent, plasticizer or an oil to obtain a natural feeling leather-like material which is soft and also moist to the touch. However, use of such treating agents is not particularly desirable, since the use of such agents alone often leads to stickiness or to bleeding of the treating agent upon lapse of time or unfavorable influences of said agent on the polyurethane. The stickiness or bleeding property of the treating agent is, of course, a function of the particular agent employed.

SUMMARY OF THE INVENTION

Accordingly, it is an object of the present invention to provide a leather-like sheet material which has low resiliency, a moist but tack-free feeling to the touch, and has good surface strength and moisture permeability.

It is a further object of the invention to provide a leather-like sheet material which has a surface and creases resembling those of natural leathers and which has improved visual characteristics, particularly with respect to the weightiness and softness of the material.

In one aspect, the invention provides a leather-like sheet material having a microporous surface and comprising a fibrous substrate layer (1) and a porous, skinless surface layer (2) having an apparent density of 0.25–0.48 g/cm$^3$ with pores having an average diameter of 15–300 μm being predominantly present therein, said pores being each enclosed by a polyurethane (polyurethane I) in which the organic diisocyanate constituent is an aromatic ring-containing organic diisocyanate, and the porous structure of said surface layer (2) being provided, at least in its surface portion, with a polyurethane (polyurethane II) prepared from an organic diisocyanate mainly comprising an aliphatic diisocyanate and/or an alicyclic diisocyanate.

In another aspect, the invention provides a leather-like sheet material comprising a fibrous substrate layer (1) and a porous, skinless surface layer (2) having an apparent density of 0.25–0.48 g/cm$^3$ with pores having an average diameter of 15–300 μm being predominantly present therein, said pores being each enclosed by a polyurethane (polyurethane I) in which the organic diisocyanate constituent is an aromatic ring-containing organic diisocyanate, the porous structure of said surface layer (2) being provided, at least in its surface portion, with a polyurethane (polyurethane II) in which the organic diisocyanate constituent is an organic diisocyanate mainly comprising an aliphatic diisocyanate and/or an alicyclic diisocyanate, and the surface of said surface layer including a coat layer composed mainly of a polyurethane in fine particle form or a coat layer of a composition composed of a polyurethane mainly in fine particle form and a polyoxyethylene- or glycerol-modified hardened oil.

In a further aspect, the invention provides a method of producing leather-like sheet materials which comprises (A) applying to one side of a fibrous substrate layer (1) a solution or dispersion of a polymer mainly comprising polyurethane I in which the organic diisocyanate constituent is an aromatic ring-containing organic diisocyanate, (B) treating the surface of the porous sheet obtained after coagulation of said solution or dispersion and provided with a porous surface layer (2) having an apparent density of 0.25–0.48 g/cm$^3$ with pores having an average diameter of 15–300 μm being predominantly present therein to thereby cause pores within the surface layer to be exposed, then (C) applying to the resulting surface a solution or dispersion of polyurethane II in which the organic diisocyanate constituent is an organic diisocyanate mainly comprising an aliphatic diisocyanate and/or an alicyclic diisocyanate, and, for finishing, (D) removing the solvent or dispersant, to thereby cause micropores to be present on the surface.

In a still further aspect, the invention provides a method of producing leather-like sheet materials which comprises (A) applying to one side of a fibrous substrate layer (1) a solution or dispersion of a polymer mainly comprising polyurethane I in which the organic diisocyanate constituent is an aromatic ring-containing organic diisocyanate, (B) treating the surface of the porous sheet obtained after coagulation of said solution or dispersion and provided with a porous surface layer (2) having an apparent density of 0.25–0.48 g/cm$^3$ with pores having an average diameter of 15–300 μm being predominately present therein to thereby cause pores within the surface layer to be exposed, then (C) applying to the resulting surface a solution or dispersion of polyurethane II in which the organic diisocyanate constituent is an organic diisocyanate mainly comprising an aliphatic diisocyanate and/or an alicyclic diisocyanate, (D) removing the solvent or dispersant, either ($E_1$) forming, for finishing, a discontinuous coat layer of a polymer mainly comprising polyurethane II to thereby cause micropores to be present on the surface, or ($E_2$) forming a fine particle polyurethane coat layer on the surface and, if necessary, (F) following with heat treatment and embossing. The fine particle coat layer($E_2$) is formed by (1) applying a solution or dispersion of a polymer mainly comprising a polyurethane to the polyurethane II-coated surface, (2) drying, then (3) applying to the resulting surface at least one composition selected from the group consisting of (i) a polyurethane dispersion containing a polyurethane dispersed therein in fine particle form; (ii) a polyurethane solution additionally containing fine polyurethane particles; (iii) a composition comprising the polyurethane dispersion (i) and a polyoxyethylene- or glycerol-modified hardened oil; and (iv) a composition comprising the polyurethane solution (ii) and a polyoxyethylene- or glycerol-modified hardened oil, and (4) removing the solvent or dispersant.

BRIEF DESCRIPTION OF THE DRAWINGS

In FIGS. 1–4, the reference numeral 1 indicates a fibrous substrate layer, 2 a porous surface layer made of polyurethane I (I in the figures), 3 a micropore, 4 a micropore coated by polyurethane II (II in the figures), 5 a larger pore coated by polyurethane II and having an average diameter of 15–300 μm, 6 a surface layer-forming fine particle polyurethane, 7 a polyoxyethylene- or glycerol-modified hardened oil, and III a nonporous continuous film layer made of a polyurethane or the like polymer.

DETAILED DESCRIPTION OF THE INVENTION

Figure 1:
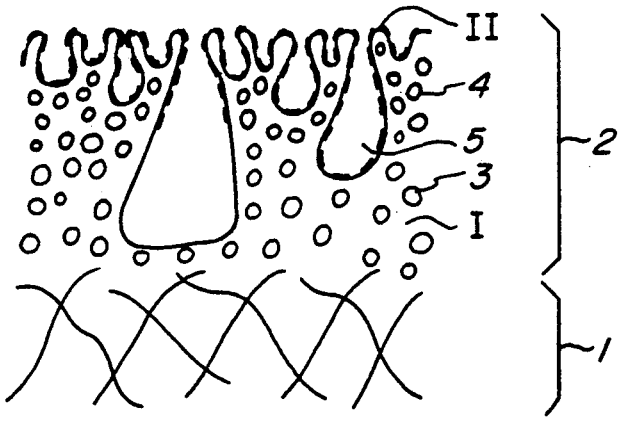
FIG. 1 is a schematic representation, in cross-section, of one embodiment of a leather-like sheet material according to the present invention.
Figure 2:
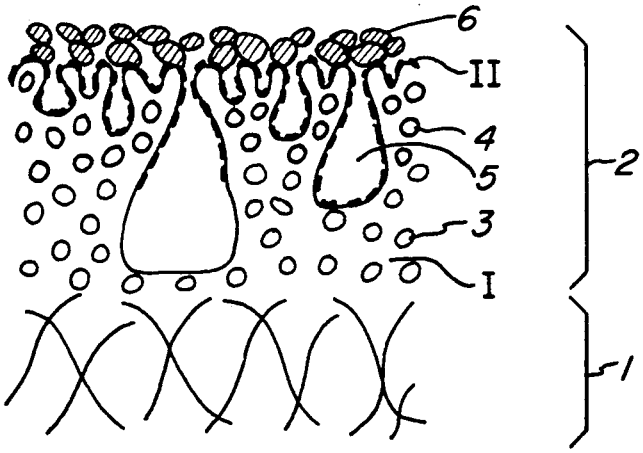
FIG. 2 is a schematic representation, in cross-section, of another embodiment of a leather-like sheet material according to the present invention.
Figure 3:
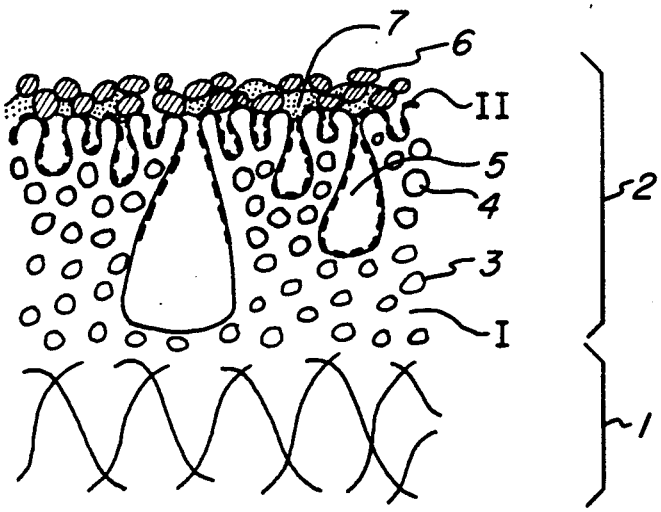
FIG. 3 is a schematic representation, in cross-section, of still another embodiment of a leather-like sheet material of the present invention.
Figure 4:
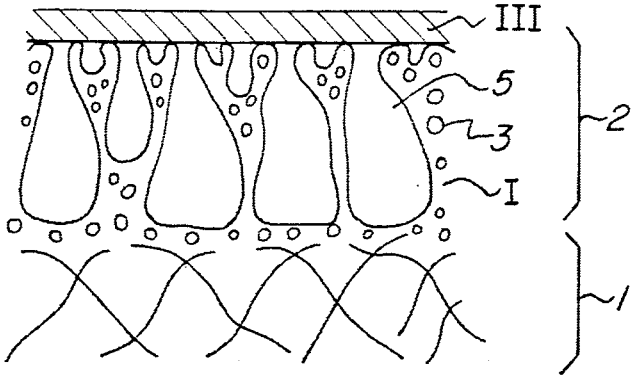
FIG. 4 is a schematic representation, in cross-section, of a conventional leather-like sheet material.

The porous sheet, which constitutes the leather-like sheet material according to the invention and is composed of a fibrous substrate layer (1) and a porous surface layer (2) mainly made of a polyurethane is a fibrous base sheet comprising a cloth as the fibrous substrate layer (1). The cloth is, for example, a woven fabric, knitted fabric, napped woven fabric, napped knitted fabric or fiber-entangled nonwoven fabric made of at least one fiber selected from among synthetic fibers manufactured from polyamides, such as nylon-6, nylon-66, nylon-10 and aromatic ring-containing polyamides, polyesters, such as polyethylene terephthalate, copolymers containing at least 80 mole percent of ethylene terephthalate units and polybutylene terephthalate, polyolefins, such as polyethylene and polypropylene, polyacrylonitrile, polyvinyl alcohol and other polymers, and regenerated fibers. When a leather-like sheet material which is soft and flexible, shows good drapability and has good appearance is particularly desired, a multicomponent fiber obtained by spinning synthetic polymers and capable of forming an ultrafine fiber or a fiber material mainly comprising such a multicomponent fiber should be used. For attaining closer resemblance in performance characteristics to natural leathers, the cloth should be one containing an elastomer such as a polyurethane, acrylic resin, synthetic rubber or polyester elastomer. Preferably, a cloth is prepared by using a multicomponent fiber, the cloth-constituting multicomponent fiber is converted to an ultrafine fiber form, either before or after treatment of the cloth for causing the same to contain an elastomer, by chemical or mechanical treatment, and the cloth is converted to an elastomer-containing one by treatment with a solution or dispersion of a polymer (elastomer) mainly comprising a polyurethane, more preferably polyurethane I, described in greater detail herein, followed by coagulation to give a porous structure.

This fibrous base sheet is provided, on one side thereof, with a porous surface layer (2) made of a polymer mainly comprising a polyurethane to give a porous sheet. The polyurethane which constitutes the surface layer (2) is a polyurethane I which is soluble in a polar solvent mainly comprising N,N-dimethylformamide and in which the organic diisocyanate constituent is an aromatic ring-containing organic diisocyanate.

A solution or dispersion of a polymer mainly comprising polyurethane I is applied to one side of the above-mentioned cloth or fibrous substrate and coagulated to give a porous layer. The porous structure of said layer may be a microporous one. However, since a surface layer having a microporous structure alone is disadvantageous in that it has high resiliency and poor drapability and is inferior in shape of creases and in appearance, a porous surface layer (2) is preferred which has an apparent density of 0.25–0.48 g/cm$^3$ and in which the pore structure in the surface layer is such that spherical, waterdrop-like or bottle-like, relatively large pores having an average pore diameter of 15–300 μm predominate, either intermingled with micropores or separated therefrom by a kind of microporous diaphragm.

For producing polyurethane I, which constitutes this porous surface layer (2), at least one polymer diol selected from among polymer diols having an average molecular weight of 500–3,000, such as polyester diols prepared by polycondensation of at least one low-molecular-weight diol (e.g. ethylene glycol, propylene glycol, 1,4-butanediol, 1,5-pentanediol, 1,6-hexanediol, 3-methylpentanediol- 1,5, etc.) and at least one dicarboxylic acid (e.g. adipic acid, pimelic acid, suberic acid, azelaic acid, sebacic acid, isophthalic acid, terephthalic acid, etc.), polyether glycols, e.g. polyethylene ether glycol, polypropylene ether glycol, polytetramethylene ether glycol, polyhexamethylene ether glycol, etc., and polylactone glycols, e.g. polycaprolactone glycol, polyvalerolactone glycol, etc. is used as a soft segment.

The aromatic ring-containing organic diisocyanate to be reacted with said polymer diol can be at least one organic diisocyanate selected from among tolylene diisocyanate, xylylene diisocyanate, phenylene diisocyanate, 4,4'-diphenylmethanediisocyanate, 2,2'-dimethyl-4,4'-diphenylmethane-diisocyanate and the like. The use of this aromatic ring-containing diisocyanate characteristically brings about stable formation of a porous structure suited for leather-like sheet materials and high mechanical and physical stability of the pore structure, among others. Therefore, some other organic diisocyanate, for example an isocyanate compound selected from among hydrogenated tolylene diisocyanate, hydrogenated xylylene diisocyanate, isophorone diisocyanate and the like, may be used in combination in an amount in which the characteristics required of leather-like sheet materials are not impaired. An organic diisocyanate mainly comprising 4,4'-diphenylmethane- diisocyanate is preferred.

The polyurethane is produced by reacting the polymer diol and the organic diisocyanate together with at least one compound containing two active hydrogen atoms and having a molecular weight of not more than 300, which is used as a chain extender. This chain extender can, for example, be selected from among diols, such as ethylene glycol, propylene glycol, 1,4-butanediol, hexanediol, 3-methylpentanediol-1,5, 1,4-cyclohexanediol and xylene glycol, diamines, such as ethylenediamine, propylenediamine, xylylenediamine, isophoronediamine, piperazine, phenylenediamine and tolylenediamine, hydrazines or hydrazides, such as hydrazine, adipic acid dihydrazide and isophthalic acid dihydrazide, and the like. The polyurethane thus obtained (polyurethane I) should be a polyurethane soluble in polar solvents comprising N,N-dimethylformamide as the main component. If the polyurethane is soluble in other solvents, satisfactory visual characteristics will not be obtained, even if said polyurethane is produced by polymerization with the same starting material composition, due to unfavorable changes in surface layer state in the subsequent processing steps, for example destruction, deformation or redissolution of the porous structure; the products will have great resiliency, undesirable feeling and poor processability to secondary products.

The porous sheet comprising the fibrous substrate layer (1) and the porous surface layer (2) of a polymer mainly comprising polyurethane I as formed on one side of said substrate layer is then subjected to surface treatment of said surface layer (2) to cause pores within the surface layer to be exposed. Thus, the surface layer surface is abraded with a sandpaper or the like for conversion thereof to a surface with most of the pores in the surface layer being exposed as a result of removal or destruction of most of the surface.

The surface obtained after removal or destruction of the skin layer is treated with a solution or dispersion of polyurethane II, which is a polyurethane differing from the surface layer-constituting polyurethane I from the solvent viewpoint. The organic diisocyanate constituent of the polyurethane II is an organic diisocyanate mainly comprising an aliphatic diisocyanate and/or an alicyclic diisocyanate, in an amount of 3–20 g/m$^2$ as polyurethane II solids, and the solvent or dispersant is removed, whereby a polyurethane II coat is formed on the porous polyurethane I face of at least the top layer of the surface layer (2). The formation of this polyurethane II film is not intended for the formation of a coat film layer for forming the so-called smooth surface on the surface layer (2) but for attaining a state in which the surface of each pore of the porous structure constituting the surface layer (2) is provided with polyurethane II.

Either after application of polyurethane II or after application of polyurethane II and the subsequent further application of a solution or dispersion of a polymer mainly comprising polyurethane II for the formation of a discontinuous, nonporous coat on the surface layer (2), the solvent or dispersant is removed, whereby a discontinuous, nonporous coat is formed on the surface layer (2). Either after application of polyurethane II to the surface layer (2) or after formation of the discontinuous coat film of a polymer mainly comprising polyurethane II, the surface is finished to a leather-like appearance by embossing under heating to convert the surface to an uneven patterned surface or a smooth surface without closing the end of each pore occurring on the surface.

It is necessary that polyurethane II to be used for the surface coating mentioned above should be a polyurethane capable of giving a soft and moist, but tack-free, feeling. For the production of such polyurethane II, at least one polymer diol having an average molecular weight of 500–3,000 and selected from among polyester diols prepared by polycondensation of at least one low-molecular-weight diol selected from among ethylene glycol, propylene glycol, 1,4-butanediol, 1,5-pentanediol, 1,6-hexanediol, 3-methylpentanediol-1,5 and the like with at least one dicarboxylic acid selected from among adipic acid, pimelic acid, suberic acid, azelaic acid, sebacic acid, isophthalic acid, terephthalic acid and the like, polyether glycols such as polyethylene ether glycol, polypropylene ether glycol, polytetramethylene ether glycol and polyhexamethylene ether glycol, polylactone glycols such as polycaprolactone glycol and polyvalerolactone glycol, and the like is used as the soft segment.

The organic diisocyanate to be reacted with the polymer diol is at least one organic diisocyanate selected from among aliphatic diisocyanates such as hexanediisocyanate, octanediisocyanate, 3-methoxy-1,6-hexanediisocyanate, nonanediisocyanate, decanediisocyanate, undecanediisocyanate and dodecanediisocyanate, alicyclic diisocyanates such as Ω, 106 '-diisocyanate-1,4-(or 1,2-)dimethylcyclohexane, cyclohexylmethanediisocyanate, 4,4'-dicyclohexylmethanediisocyanate and isophoronediisocyanate, and the like.

At least one compound containing two active hydrogen atoms and having a molecular weight of not more than 300 is used as a chain extender, for example one selected from among diols such as ethylene glycol, propylene glycol, 1,4-butanediol, hexanediol, 3-methylpentanediol-1,5, 1,4-cyclohexanediol and xylene glycol, diamines such as ethylenediamine, propylenediamine, xylylenediamine, isophoronediamine, piperazine, phenylenediamine and tolylenediamine, hydrazines and hydrazides such as hydrazine, adipic acid dihydrazide and isophthalic acid dihydrazide, and the like. A diamine-extented polyurethane is particularly preferred.

The thus-obtained polyurethane (polyurethane II) should be a polyurethane soluble in a solvent other than polar solvents such as N,N-dimethylformamide. Therefore, a polyurethane soluble only in polar solvents such as N,N-dimethylformamide is not suited for use as polyurethane II even if it is obtained by polymerization from the same starting material composition, since the use of such solvents in the relevant process step will perhaps unfavorably result in redissolution of polyurethane I in the porous structure previously formed or in destruction or deformation of the porous structure. Furthermore, such polyurethane has a high degree of polymerization and/or side chains and the use thereof results in decreased softness and flexibility and/or failure to give a moist feeling, hence failure to provide the desired characteristic features which the invention is to provide.

As the solvent for polyurethane II, there may be mentioned, for example, tetrahydrofuran, acetone, methyl ethyl ketone, cyclohexanone, toluene, xylene, cyclohexane, ethyl acetate, methylcellosolve, cellosolve acetate, isopropanol, dioxane and the like. These solvents may be used either singly or in admixture. Even N,N-dimethylformamide may be used combinedly in an amount of 15% or less in which it will not attack polyurethane I. In that case, the bond between polyurethane I and polyurethane II is improved and the break strength of the porous surface layer is increased.

The application amount of polyurethane II, embossing conditions and other factors must be adjusted so that pores having a size of 20 μm or less, preferably 15 μm or less, predominate among the micropores occurring on the surface. The adjustments to obtain preferable pore size can be readily made by one skilled in the art.

The polyurethane dispersion containing a polyurethane dispersed therein in fine particle form or the polyurethane solution additionally containing a polyurethane in fine particle form, which is to be applied to the leather-like sheet material surface in accordance with the invention, contains a polyurethane produced by reacting a polymer diol having an average molecular weight of 500–2,000 as selected from among polyester diols, polyether diols, polyester-ether diols, polylactone diols, polycarbonate diols and the like, at least one organic polyisocyanate selected from among hexanediisocyanate, octanediisocyanate, nonanediisocyanate, xylylene diisocyanate, cyclohexylmethanediisocyanate, Ω, Ω'-diisocyanate-1,4-(or 1,2)-dimethylcyclohexane, 4,4'-dicyclohexylmethanediisocyanate, isophorone-diisocyanate, phenylene diisocyanate, tolylene diisocyanate, 4,4'-diphenylmethanediisocyanate, 2,2'-dimethyl-4,4'-diphenylmethane-diisocyanate, toluenetriisocyanate, biphenyltriisocyanate, 4,4', 4''-triphenylmethanetriisocyanate and the like, and at least one of low-molecular-weight diols, triols, diamines, hydrazides and the like, in a solvent or nonsolvent system for the polyurethane. This polyurethane is caused to occur in fine particle form by partial use of a trifunctional material capable of forming a crosslinked polyurethane in the starting material composition for polyurethane manufacture, by conducting the polymerization for polyurethane manufacture in a nonsolvent or a poor solvent for the product polyurethane to thereby allow the product polyurethane to precipitate therein in particle form, by mechanically dispersing a polyurethane dissolved in a solvent into a nonsolvent or a poor solvent for the polyurethane, or by some other adequate means. When the particle-form polyurethane has a particle size within the range of 1–20 μm, preferably 1.5–10 μm, leather-like sheet materials having good surface appearance, high surface strength and other favorable physical characteristics can be obtained.

The polyoxyethylene- or glycerol-modified hardened oil to be used in admixture with the polyurethane in fine particle form is a product derived from an adequate raw material, for example a natural oil, such as castor oil, linseed oil, cottonseed oil, poppy oil or tung oil, or a synthetic unsaturated higher fatty acid, such as ricinoleic acid, linoleic acid or linolenic acid, by appropriate processing followed by addition of 5–500 moles, preferably 10–100 moles, of ethylene oxide or addition of glycerol. Such modified hardened oil is used in an amount of 5–100% by weight based on the fine-particle polyurethane or the polyurethane mainly comprising a fine-particle polyurethane.

The fine-particle polyurethane dispersion or fine-particle polyurethane-containing polyurethane solution, with or without the polyoxyethylene- or glycerol-modified hardened oil added thereto, is applied to the surface of the leather-like sheet material in an amount of 0.5–15 $g/m^2$ (as polyurethane solids) by the gravure, spray or slit coat method, for instance. The use of such composition, in large amounts, is not recommended, as use of large amounts results in impairment of the surface feel and decreases physical characteristics of the surface.

Additives such as light stabilizer, antioxidant, water repellent, oil repellent and colorant may be added to polyurethane I and polyurethane II, which constitute the surface layer in accordance with the invention. Alternatively, the leather-like sheet material may be treated in the finishing step for providing it with an antioxidant, light stabilizer, water repellent, oil repellent, softening agent, colorant, coloration or discoloration inhibitor, and/or the like.

The leather-like sheet material according to the invention can be finished to a final product by embossing for giving it a variety of uneven surface patterns and finish-processing for applying a luster-adjusting agent and/or a color tone adjusting agent, dyeing, rumpling, and/or softening, for instance.

The leather-like sheet material provided by the invention has a soft surface texture featuring a tack-free, moist feeling, a full-bodied flexibility with wrinkles, creases and drapability resembling those of natural leather, and a deep and dark color tone. It has excellent properties such as moisture permeability, structure break strength and surface strength. Therefore, this leather-like sheet material is useful in processing products such as shoes, particularly sports shoes, as well as articles of clothing, bags and pouches, gloves and the like.

The following examples are further illustrative of the present invention. It should be understood, of course, that the invention is not necessarily limited to the particular embodiments illustrated therein. In the examples, "part(s)" and "%" are on the weight basis unless otherwise specified.

EXAMPLE 1

A polyurethane (polyurethane I) was prepared by reacting 200 parts of polybutylene adipate glycol having an average molecular weight of 2,000, 163 parts of 4,4'-diphenylmethanediisocyanate and 34 parts of ethylene glycol. This polyurethane I had a hard segment content (calculated value) of 49.6%, and showed a solution viscosity of 2.7 poises at 30° C. in an N,N-dimethylformamide solution having a polyurethane concentration of 10%. A polyurethane-containing liquid for nonwoven fabric impregnation was prepared from that polyurethane according to the following formulation: 13 parts of the polyurethane, 0.4 part of a coagulation controlling agent, 0.5 part of a colorant and 86.1 parts of N,N-dimethylformamide. Separately, a polyurethane-containing liquid composition for surface coating was prepared according to the following formulation: 13 parts of the polyurethane, 0.26 part of a coagulation controlling agent, 0.25 part of a cellular formation controlling agent, 0.5 part of a colorant, 1 part of water and 84.99 parts of N,N-dimethylformamide.

Then, a nonwoven fabric made by entanglement of a polyester fiber mat and having a weight of 243 g/m$^2$, an apparent density of 0.27 g/cm$^3$ and a thickness of 0.9 mm was impregnated with the above-mentioned polyurethane composition for impregnation, then coated, on one side thereof, with the above-mentioned polyurethane I composition for surface coating in an amount of about 750 g/m$^2$. The polyurethane-impregnated fabric was then immersed in a coagulating bath comprising a 30% aqueous solution of N,N-dimethylformamide and maintained at a temperature of 28° C. for coagulation of the polyurethane, after which it was washed with water and dried to give a porous sheet (hereinafter referred to as "porous sheet A"). Porous sheet A comprised a fibrous substrate layer consisting of the polyester fiber-entangled nonwoven fabric and the polyurethane contained therein in porous state on one hand and, on the other, a porous surface layer provided on one side of said fibrous substrate layer and having a thickness of about 0.35 mm and an apparent density of 0.28 g/cm$^3$ as measured with a slice of said surface layer, with bottle-shaped pores having an average diameter within the range of 140–210 μm being arranged on the surface in a direction almost perpendicular thereto.

The surface of the surface layer of porous sheet A was buffed with a sandpaper to remove a thickness of about 0.08 mm, whereby the skin layer was almost completely removed and internal pores were exposed.

Figure 5:
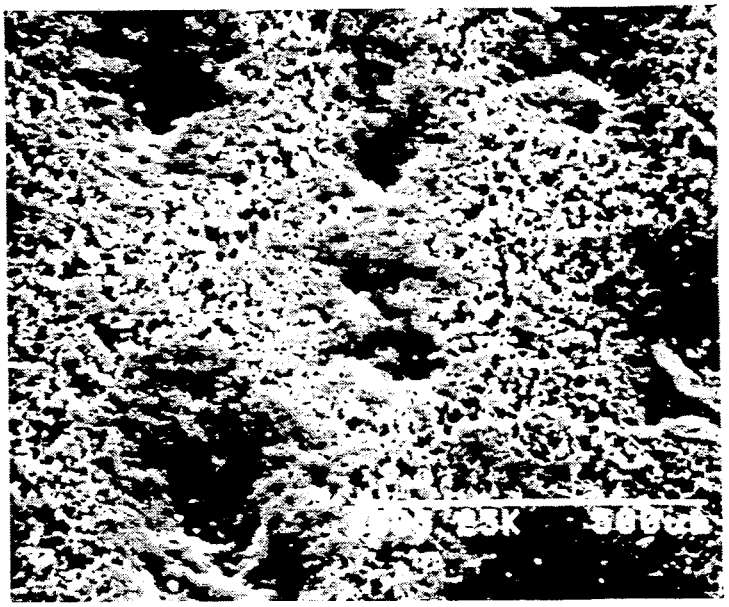
FIG. 5 is a photomicrograph of an embossing-finished leather-like sheet material corresponding to the material schematically represented in FIG. 1.
Figure 6:
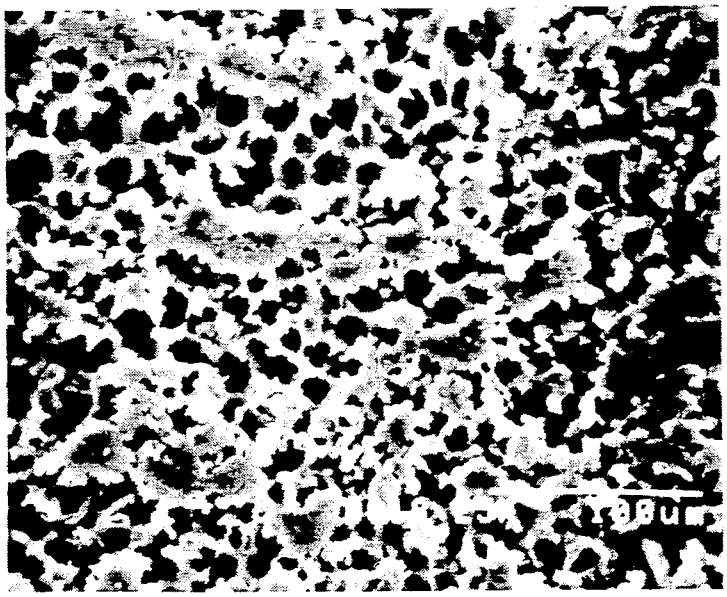
FIG. 6 is a photomicrograph which is a partial enlargement of FIG. 5.

Polyurethane II for surface coating was prepared by reacting 140 parts of polycaprolactone glycol having an average molecular weight of 1,400, 81 parts of 4,4'-dicyclohexylmethanediisocyanate and 34 parts of isophoronediamine in the manner of solution polymerization. This polyurethane II was dissolved in a mixed solvent composed of tetrahydrofuran, cyclohexanone and isopropanol, followed by addition of a colorant to give an 8% solution of polyurethane II. This polyurethane solution was applied to the surface obtained by the above-mentioned buffing in two steps by means of a gravure roll in an amount of about 5 g/m$^2$ on the dry polyurethane basis. This polyurethane was found to have permeated the porous structure surface to a depth of about 0.2 mm from the surface. After drying, a solution of polyurethane II in the above-mentioned mixed solvent, with a colorant and citric acid added thereto, was applied to the uppermost surface portion in an amount of about 2.5 g/m$^2$ (as polyurethane) by means of a gravure roll and then dried. The sheet was finished by embossing for providing it with a cowhide pattern on the surface. A photomicrograph of the surface state of the thus-obtained finished leather-like sheet material as made with a scanning electron microscope is shown in FIG. 5. An enlargement of part of FIG. 5 is shown in FIG. 6. As shown in FIGS. 5 and 6, there were a large number of micropores present on the leather-like sheet material surface, looking like pores of the animal skin. The moisture permeability was 1,320 g/m$^2$ 24 hrs and the air permeability was 52 seconds/100 cc. This leather-like sheet material, the leather-like sheet materials prepared in Comparative Examples 1 and 2 to be mentioned hereinbelow and a prior art leather-like sheet material were subjected to organoleptic testing by 20 panelists chosen at randon. The results obtained are shown below in Table 1.

The prior art sheet material subjected to organoleptic testing in this Example 1 and in Example 7 below is Clarino® #5014, a leather-like sheet material for basketball and soccer shoes manufactured made by Kuraray Co., Ltd. of Japan. This prior art sheet material was prepared as follows. A nonwoven fabric made by entanglement of an oriented-multihole nylon fiber mat was impregnated with a polyethylene adipate polyurethane composition for impregnation in the same manner as described in Example 1 above. The polyurethane-impregnated fabric was then coated on one side with polyurethane I and immersed in a coagulation bath to coagulate the polyurethane in a porous state. The surface of the prepared sheet was then surface coated with polyurethane I in an amount of approximately 5.1 μm on the dry polyurethane basis. The resulting sheet material was finished by embossing.

TABLE 1

| Leather-like sheet | Hand feeling | Wrinkles and creases | Touch | Drapability | Evaluation |
|---|---|---|---|---|---|
| Example 1 | ◎ | ◎ | Moist | ◎ | ◎ |
| Comparative Example 1 | x | x | Dry | x | x |
| Comparative Example 2 | x | x | Moist | x | x |
| Prior art sheet material | Δ | Δ-o | Dry | x-Δ | Δ |

As used in Table 1 and in the other Examples herein, the symbols used to report the results of organoleptic testing have the following meanings:

◎= Excellent
o= Good
Δ= Moderate
X= Poor
o-Δ= Good to Moderate

The leather-like sheet material according to the invention was thus excellent from the organoleptic viewpoint.

COMPARATIVE EXAMPLE 1

A solution of polyurethane I was prepared by dissolving polyurethane I in the solvent N,N-dimethyl-formamide and diluting the solution with a mixed solvent composed of tetrahydrofuran and cyclohexanone and was then applied, in the same manner as in Example 1, to the surface of the same porous sheet as obtained in Example 1 after removal of the skin layer. The polyurethane solution was then allowed to dry.

In this case, part of the surface was redissolved and thereafter dry coagulated, so that the micropores in the surface portion were destructed, and rendered the surface markedly uneven. Furthermore, the dry-formed coat was lacking a moist feeling. The leather-like sheet material appeared to feel hard, and showed a rigid manner of creasing. It had a decreased moisture permeability of 715 g/m$^2$.24 hrs

COMPARATIVE EXAMPLE 2

The same solution of polyurethane II as prepared in Example 1 was applied, under the same conditions as used in Example 1, to the surface of the surface layer of porous sheet A prepared in the same manner as in Example 1, without removing the skin layer therefrom. The surface of the thus-finished leather-like sheet material gave a moist feeling but visually gave an impression of feeling hard. The manner of creasing was rigid, due to failure of polyurethane II to penetrate into the inside of the surface layer and due to formation of a continuous dry-formed coat film on the surface. The moisture permeability was as low as 319 g/m$^2$.24 hrs.

The three samples were tested for break strength of the porous structure in the surface layer. The results were as follows:

| | |
|---|---|
| Sample of Example 1 | 6.6 kg/25 mm |
| Sample of Comparative Example 1 | 4.7 kg/25 mm |
| Sample of Comparative Example 2 | 3.1 kg/25 mm |

The leather-like sheet material of Example 1 was excellent also in peel strength (structural break strength) of the surface layer.

EXAMPLE 2

Polyurethane I was prepared by reacting 150 parts of polyethylene adipate glycol having an average molecular weight of 1,500, 152 parts of 4,4'-diphenylmethanediisocyanate and 45 parts of 1,4-butanediol. A 10% solution of this polyurethane I in N, N-dimethylformamide had a solution viscosity of 3.9 poises as measured at 30° C. A composition composed of 15 parts of polyurethane I, 0.3 part of coagulation controlling agent, 0.45 part of a cellular formation controlling agent, 0.5 part of a colorant and 83.75 parts of N,N-dimethylformamide was prepared and applied to a polypropylene sheet in an amount of 770 g/m$^2$ (as solution). Coagulation by immersion in a 30% aqueous solution of N,N-dimethylformamide followed by washing with water and drying of the coagulum gave a porous polyurethane sheet (porous sheet B). This porous sheet B had a weight of 116 g/m$^2$, a thickness of 0.33 mm and an apparent density of 0.35 g/cm$^3$, with waterdrop-shaped pores having an average diameter of 70–125 μm being arranged on the surface in a direction almost perpendicular to the surface. This porous sheet B was caused to adhere, by the solvent adhesion method, to one side of a 0.85-mm-thick, porous, fibrous substrate prepared in advance by causing a nonwoven fabric made by entangling a 6-nylon Ultrafine fiber bundle fiber mat to contain a porous polyurethane, whereby the fibrous substrate was provided with the porous sheet as the surface layer. Then, the skin layer (about 0.07 mm thick) of this surface layer was removed by buffing, so that internal pores were exposed.

Polyurethane II for surface coating was prepared by reacting 20 parts of polyoxyethylene glycol having an average molecular weight of 2,000, 14.4 parts of poly-3-methylpentane-1,5 adipate glycol having an average molecular weight of 1,600, 67 parts of isophoronediisocyanate and 34 parts of isophoronediamine in the manner of solution polymerization. This polyurethane II was dissolved in a mixed solvent composed of tetrahydrofuran, cyclohexanone and isopropanol, followed by addition of a colorant. Polyurethane II solution was applied, by the gravure method, to the surface of the above-mentioned porous surface layer obtained after removal of the skin layer, and was dried. Polyurethane II penetrated to about three fourths of the surface layer thickness, the coat weight being about 10 g/m$^2$. Most of polyurethane II was consumed for covering the surface of porous polyurethane 1 and almost no surface film of polyurethane II was formed. The resultant sheet was then embossed with a pear skin-patterned embossing roll, whereby the sheet surface assumed an appearance of a mixture of pear skin surface and a porous, uneven surface. The surface was different from that monotonously patterned surface obtained artificially by means of a roll but had a characteristic appearance, with tack-free, moist feel, softness, flexibility and drapability. The wrinkles and creases were pretty and resembled that of genuine leathers. The product sheet material had a good surface layer structure break strength of 5.1 kg/25 mm and a good moisture permeability of 1,200 g/m$^2$.24 hrs.

This leather-like sheet material was suited for use in manufacturing shoes, bags and pouches from both appearance and feeling viewpoints.

EXAMPLES 3–6

Polyurethane I was prepared by reacting 200 parts of polytetramethylene ether glycol having an average molecular weight of 2,000, 35 parts of tolylene diisocyanate and 21 parts of 4,4'-diaminodicyclohexylmethane. A liquid composition was prepared from 13 parts of this polyurethane I, 0.3 part of a coagulation controlling agent, 1 part of water, 1 part of titanium oxide and 84.7 parts of N-N-dimethylformamide and applied to a water repellent-finished, napped cloth in an amount of 740 g/m$^2$ (as liquid composition). Coagulation by immersion in a 30% aqueous solution of N,N-dimethylformamide followed by washing with water and drying gave a porous sheet (porous sheet C) composed of a fibrous substrate layer and a porous surface layer. The porous structure of this surface layer was such that bottle shaped pores having an average diameter within the range of about 105–200 μm were arranged on the sheet surface in a direction almost perpendicular to said surface. The surface of this surface layer was buffed with a No. 320 sandpaper, whereby the surface skin layer was mostly destructed and removed and internal micropores were exposed.

Polyurethane II for surface coating was prepared by reacting 150 parts of a mixed polymer glycol composed of 40 parts of polytetramethylene ether glycol having an average molecular weight of 1,500, 15 parts of polyethylene ether glycol having an average molecular weight of 1,500 and 45 parts of polyhexamethylene carbonate glycol having an average molecular weight of 1,500, 28 parts of 4,4'-dicyclohexylmethane diisocyanate, 10 parts of hexamethylene diisocyanate and 17 parts of isophoronediamine. A composition for surface coating was prepared from 8 parts of this polyurethane II, 2.4 parts of titanium oxide, 0.08 parts of an antioxidant and 89.5 parts of a mixed solvent composed of tetrahydrofuran, cyclohexanone and isopropanol. This polyurethane II solution was applied to the above-mentioned buffered surface by means of a gravure roll, and dried. Then, the sheet was finished by embossing for providing a kip pattern. The thus-obtained leather-like sheet material was evaluated for performance characteristics. The results obtained are shown in Table 2.

TABLE 2

| Sample | Surface coat weight ($g/m^2$) | Hand Feeling and touch | Wrinkles and creases | Moisture permeability ($g/m^2$ · 24 hrs) | Air permeability (min./100 cc) |
|---|---|---|---|---|---|
| Example 3 | 2.2 | ◎ | ◎ | 2177 | 11 |
| Example 4 | 4.9 | ◎ | ◎ | 1935 | 29 |
| Example 5 | 8.3 | ◎ | ◎ | 1520 | 52 |
| Example 6 | 11.7 | ○ | ○ | 1145 | 107 |

The leather-like sheet materials according to the invention were thus found to be excellent leather-like sheet materials. Increases in surface coat weight resulted only in small decreases in organoleptic performance characteristics, such as feeling, touch and wrinkles and creases.

EXAMPLE 7

Polyurethane I was prepared by reacting 200 parts of polyethylene adipate glycol having an average molecular weight of 2,000, 163 parts of 4,4'-diphenylmethanediisocyanate and 34 parts of ethyelne glycol. This polyurethane I had a hard segment cotent of 49.6% (calculated value), and a solution viscosity of 2.9 poises as measured at 30° C. with a 10% polyurethane solution in N,N-dimethylformamide. A polyurethane commposition for nonwoven fabric impregnation was prepared from 15 parts of this polyurethane I, 0.5 part of coagulation controlling agent, 0.5 part of a colorant and 84.0 parts of N,N-dimethylformamide. Separately, a polyurethane composition for surface coating was prepared from 13 parts of the polyurethane, 0.26 part of a coagulation controlling agent, 0.25 part of cellular formation controlling agent, 0.5 part of a colorant, 1 part of water and 85 parts of N,N-dimethylformamide.

A fiber-entangled nonwoven fabric made of a polyethylene terephthalate-polyethyelne composite fiber and having a weight of 470 $g/m^2$, an apparent density of 0.31 $g/cm^3$ and a thickness 1.5 mm was impregnated with the above-mentioned polyurethane composition for impregnation and further coated, on one side, with about 750 $g/m^2$ of the polyurethane composition for surface coating. The fabric was then immersed in a coagulating bath comprising a 30% aqueous solution of N,N-dimethylformamide and maintained at a temperature of 28° C. for coagulation of the polyurethane and reimmersed in a solvent bath to extract the polyethylene in the fiber, then washed with water and dried to give a porous sheet composed essentially of a fibrous substrate layer made of an entangled polyethylene terephthalate ultrafine fiber bundle fiber and containing the polyurethane in a porous state and a porous surface layer provided on one side of said fibrous substrate layer and having a thickness of about 0.35 mm and an apparent density of 0.28 $g/cm^3$ as measured with a slice of said surface layer, with bottle-shaped pores having an average diameter within the range of 140–210 μm being arranged on the surface in a direction almost perpendicular to said surface.

Then, the surface of the surface layer of the porous sheet was buffed with a sandpaper until a thickness of about 0.08 mm was removed. Most of the skin layer was thus removed and internal pores were exposed.

Polyurethane II for surface application was prepared by reacting 140 parts of polycaprolactone glycol having an average molecular weight of 1,400, 81 parts of 4,4'-dicyclohexylmethanediisocyanate and 34 parts of isophoronediamine in the manner of solution polymerization. By dissolving this polyurethane II in a mixed solvent composed of tetrahydrofuran, cyclohexanone and isopropanol, an 8% solution of polyurethane II with a colorant added thereto was prepared. This polyurethane II solution was applied to the above-mentioned buffed surface in two steps in an amount of about 5 $g/m^2$ (as dry polyurethane) by means of a gravure roll. The polyurethane permeated into the porous structure to a depth of about 0.2 mm from the surface. Then the sheet was dried, embossed, coated with a polyurethane composition containing a surface coloring agent and staked to give a porous sheet (porous sheet D).

Figure 7:
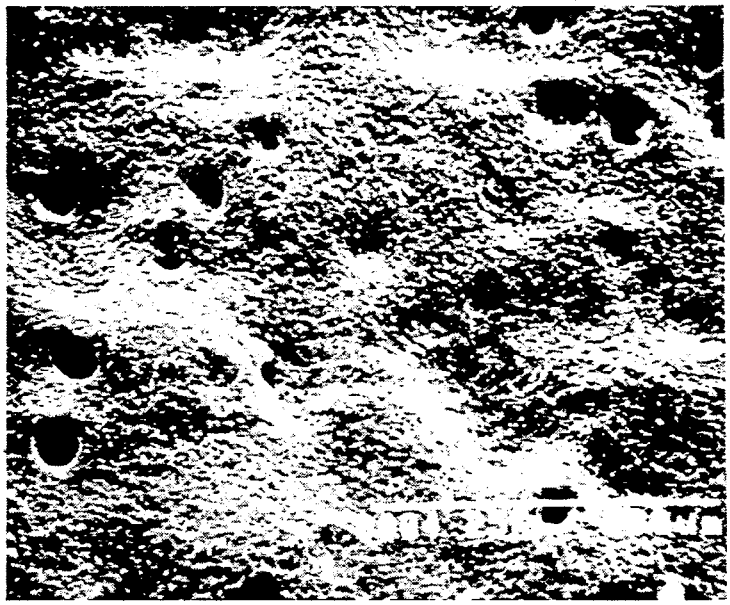
FIG. 7 is a photomicrograph of an embossing-finished leather-like sheet material corresponding to the material schematically represented in FIG. 3.
Figure 8:
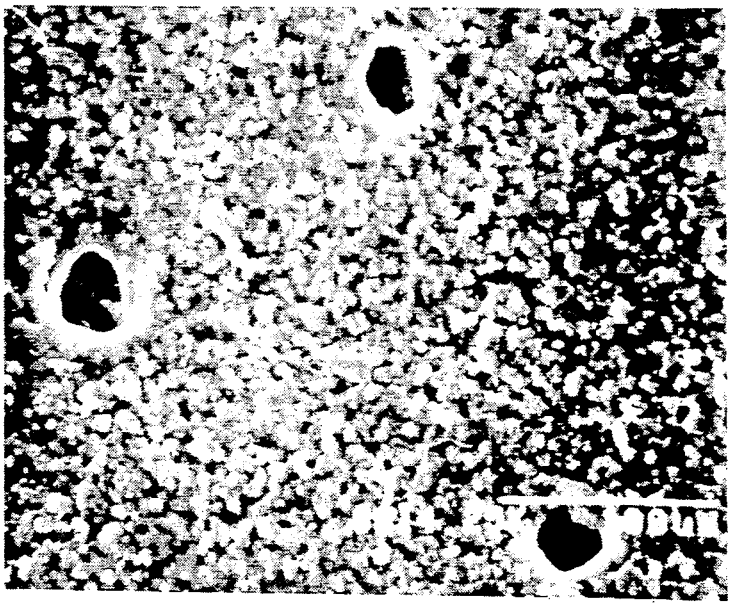
FIG. 8 is a photomicrograph which is a partial enlargement of FIG. 7.

Separately, a fine-particle polyurethane composition for application to the surface of porous sheet D (surface coating composition I) was prepared by mixing a dispersion of a fine-particle polyurethane having an average particle size of 3.7 μm as obtained by polymerizing polyoxypropylene glycol, 4,4'-diphenylmethanediisocyanate, 4,4',4''-triphenylmethanetriisocyanate and isophoronediamine in a nonsolvent system and a solution of polyurethane II in a ratio of 80:20 (on the polyurethane basis). This composition I was applied to porous sheet D in two steps in an amount of about 4.5 $g/m^2$ (as polyurethane) by means of a gravure roll. After drying, there was obtained a leather-like sheet material (sheet I). A photomicrograph of the surface state of this material as made with a scanning electron microscope is shown in FIG. 7. FIG. 8 is an enlargement of part of the photomicrograph shown in FIG. 7. As shown, micropores observable under the microscope at the magnification of 100 times were present on the surface in an average density of 1,270 pores/$cm^2$, and sheet I had a moisture permeability of 1,370 $g/m^2$.24 hrs and a surface layer porous structure break strength of 5.9 kg/25 mm and proved to be an excellent one.

For comparison, a solution of polyurethane I in a mixed solution composed of N,N-dimethylformamide, tetrahydrofuran and cyclohexanone was applied to the surface of porous sheet D in two steps in an amount of about 4.5 $g/m^2$ (as polyurethane) by means of a gravure roll. After drying, the coated sheet was embossed and rumpled- to give a leather-like sheet material (sheet II). This leather-like sheet material showed almost no micropores on the surface at the magnification of 100 times and had a decreased moisture permeability of 685 $g/m^2$.24 hrs.

For further comparison, the fine-particle polyurethane-containing surface coating composition (composition I) prepared in Example 7 was applied to the surface of the porous sheet before surface skin layer removal in two steps in an amount of about 4 5 $g/m^2$ (as polyurethane) by means of a gravure roll. After drying, the coated sheet was embossed and rumpled to give a leather-like sheet material (sheet III). This leather-like sheet material showed no micropores on the surface at the magnification of 100 times and had a decreased moisture permeability of 491 g/m$^2$.24 hrs.

These leather-like sheet materials (sheets I, II and III) and a prior art leather-like sheet material were subjected to organoleptic testing by 20 panelists chosen at random. The results obtained are summarized below in Table 3.

TABLE 3

| Leather-like sheet material | Hand feeling | Wrinkles and creases | Touch | Drapability | Surface-abrasion resistance* | Evaluation |
|---|---|---|---|---|---|---|
| Sheet I of Example 7 | ◎ | ◎ | Moist | ◎ | ◎ | ◎ |
| Sheet II of Comparative Example | x | x | Dry and slippy | x | x | x |
| Sheet III of Comparative Example | x | x | Moist | x | x-Δ | x |
| Prior art sheet | Δ | Δ-○ | Dry and slippy | x-Δ | x-Δ | Δ |

*Soccer shoes were manufactured and tested in actual wearing.

The sheet material according to the invention was thus excellent in organoleptic characteristics and in surface abrasion resistance.

EXAMPLE 8-14

A fine-particle polyurethane-containing surface coating composition (composition II) having a polyurethane concentration of 8% was prepared by adding, to the fine particle polyurethane dispersion prepared in Example 7, polyoxyethylene-added hardened castor oil in an amount of 50% on the fine particle polyurethane basis.

A surface coating composition (composition III) having a polyurethane concentration of 8% was prepared by admixing the fine particle polyurethane dispersion prepared in Example 7 (in an amount of 80% as polyurethane), a solution of polyurethane II (in an amount of 20% as polyurethane) and polyoxyethylene-added hardened castor oil (in an amount of 40% on the total polyurethane basis).

One or the other of the surface coating compositions prepared in the above manner was then applied to the surface of porous sheet D obtained Example 7 by means of a gravure roll and then dried. Typical characteristics of the prepared leather-like sheet materials are shown below in Table 4.

TABLE 4

| Sample | Surface coating composition | Coat weight (g/m$^2$) | Hand feeling | Wrinkles and creases | Touch | Moisture permeability (g/m$^2$ · 24 hrs) | Evaluation |
|---|---|---|---|---|---|---|---|
| Example 8 | II | 1.9 | ◎ | ◎ Many | Moist | 1625 | ◎ |
| Example 9 | II | 4.3 | ◎ | ◎ fine, | and | 1190 | ◎ |
| Example 10 | II | 7.5 | ○ | ◎ long | good | 857 | ◎ |
| Example 11 | II | 10.8 | ○ | ○ creases | | 770 | ○ |
| Comparative Example 3 | II | 16.9 | x | x (breaking) | Sticky | 520 | x |
| Example 12 | III | 4.4 | ◎ | ◎ Many | Moist | 1145 | ◎ |
| Example 13 | III | 7.3 | ◎ | ◎ fine, | and | 842 | ◎ |
| Example 14 | III | 11.2 | ○ | ○ long | good | 775 | ○ |
| Comparative Example 4 | III | 16.7 | Δ | x creases ing | sticky | 480 | x |

The leather-like sheet materials according to the invention were made up into soccer shoes. The shoes were comfortable to wear and served excellently in kicking balls. The materials were also made up into men's shoes, which were soft and comfortable to wear and had a dark and quiet surface color tone.

What is claimed is:

1. A leather-like sheet material having a micro-porous surface comprising:

a fibrous substrate layer having applied thereto:

a porous, skinless surface layer of a first polyurethane composition that is applied in a polar solvent and has as the polyurethane diisocyanate constituent an aromatic-ring containing organic diisocyanate, wherein the layer contains pores having an average diameter of from about 15-300 micrometers and the layer has an apparent density of 0.25-0.48$^{gm}/_{cm}3$ and applied thereto;

a second polyurethane applied in a non-polar solvent so as to avoid dissolving said first polyurethane composition, wherein the second polyurethane composition has as the organic diisocyanate constituent an organic diisocyanate consisting essentially of an aliphatic diisocyanate or an alicyclic diisocyanate or a combination thereof, wherein said second polyurethane composition partially permeates and replicates the porous surface of said first polyurethane composition.

2. A leather-like sheet material according to claim 1 wherein the surface of said surface layer further comprises a layer of polyurethane primarily in fine particle form.

3. A leather-like sheet material according to claim 1 wherein the surface of said surface layer further comprises a layer of a composition including a polyurethane primarily in fine particle form and a polyoxyethylene or glycerol-modified hardened oil.

* * * * *